United States Patent [19]

Dehart et al.

[11] 4,251,027

[45] Feb. 17, 1981

[54] VARIABLE VOLUME CONTROL ASSEMBLY

[75] Inventors: Marv L. Dehart, Mesquite; M. Leon Kloostra, Rowlett; Harold E. Straub, Garland, all of Tex.

[73] Assignee: Environmental Elements Corporation, Baltimore, Md.

[21] Appl. No.: 122,079

[22] Filed: Feb. 15, 1980

Related U.S. Application Data

[63] Continuation-in-part of Ser. No. 849,503, Nov. 7, 1977, Pat. No. 4,196,849.

[51] Int. Cl.[3] ..... F24F 7/04

[52] U.S. Cl. ..... 236/49; 73/861.65; 137/500

[58] Field of Search ..... 236/49; 73/212, 213; 137/502, 500

[56] References Cited

U.S. PATENT DOCUMENTS

| | | | |
|---|---|---|---|
| 1,559,155 | 10/1925 | Bullock . | |
| 2,588,136 | 3/1952 | Mallory | 123/103 |
| 3,687,364 | 8/1972 | McNabney | 236/49 |
| 3,806,027 | 4/1974 | Ginn et al. | 236/49 |
| 3,809,314 | 5/1974 | Engelke et al. | 236/49 |
| 4,077,567 | 3/1978 | Ginn et al. | 236/49 |
| 4,083,245 | 4/1978 | Osborn | 73/207 |
| 4,130,017 | 12/1978 | Benedict et al. | 73/194 R |

*Primary Examiner*—Albert J. Makay
*Assistant Examiner*—William E. Tapolcai, Jr.
*Attorney, Agent, or Firm*—Herbert J. Zeh, Jr.; Oscar B. Brumback

[57] ABSTRACT

An improved variable volume control assembly for conditioned air systems having an improved air flow amplifying sensing means that amplifies the difference between the total pressure and the static pressure and is sensitive at low pressures, an improved air flow collector-straightener, a critical ratio of the area of the inlet to the area of the expansion chamber, and a vortex filter strategically located within the assembly for maximum reduction of turbulence and noise.

4 Claims, 7 Drawing Figures

VARIABLE VOLUME CONTROL ASSEMBLY

CROSS-REFERENCE TO RELATED APPLICATION

This application is a continuation-in-part of application Ser. No. 849,503 filed Nov. 7, 1977, now U.S. Pat. No. 4,196,849.

BACKGROUND OF THE INVENTION

The present invention is directed to a control assembly for use in conditioned air distribution systems of the type wherein air, conditioned at a central source, is distributed to a plurality of different rooms or areas within a room. More particularly, this invention is directed to an improved variable volume control assembly for use in conditioned air distribution systems.

Air is used as the medium of thermal transfer in all forced air heating and air conditioning systems. In such systems, air is heated and/or cooled at a central source and the conditioned air (hereinafter inclusive of heated or cooled air) is distributed to a plurality of zones through a system of ducts and outlets. There are generally two different methods for controlling the flow of conditioned air, the constant volume method and the variable volume method. In the constant volume method, the flow of conditioned air into any zone is somewhat constant but the temperature of the conditioned air is varied by either changing the source of air or by mixing hot and cold air. This constant volume system thus requires a constant source of different types of conditioned air. This system generally requires dual ducting and also requires a means for controlling the mixing of the hot air and cold air. This type of blending consumes excessive energy. The variable volume method, on the other hand, employs conditioned air at a somwhat constant temperature but varies the volume of conditioned air delivered to any particular zone in response to the demand of the zone.

As is known in the art, the variable volume system offers many advantages over the use of the constant volume system. The variable volume system requires only one source of conditioned air at a somewhat constant temperature while the constant volume system requires two sources of thermal energy. The variable volume system requires only a single duct system while the constant volume system requires a dual thermal energy system with a means for controlled mixing of the different thermal levels of conditioned air. The variable volume system is advantageous for heating or cooling the interior of standard office buildings, particularly perimeter or exterior facing rooms. Larger energy savings are possible with variable volume systems than other means of controlling the heating and cooling of a building.

Even though the variable volume system is preferred, it is not without its own drawbacks. Humidity control of the air is not as good as blending types of systems. Variable volume systems can be reduced to very low room air changes and where heavy smoking is present, an insufficient air change can occur. Most terminal control assemblies used in the variable volume system are designed to operate within a certain volume range and operation above this range causes undesirable levels of noise and, in fact, operation within the range usually causes considerable noise. Present variable volume terminal assemblies have high pressure loss values and require excessive fan horsepower to deliver the desired volume of air. Additionally, the air flow pressure sensing means used in existing variable volume control assemblies is not as sensitive as desired and does not offer pressure independent control over a wide range of flow rates.

SUMMARY OF THE INVENTION

It is an object of the present invention to provide an improved variable volume control assembly, particularly a control assembly that does not suffer from the drawbacks of the prior art assemblies.

It is also an object of the present invention to provide a variable volume control assembly that has a more sensitive air flow sensing means and that operates with pressure independant control, thereby giving better control over the amount of conditioned air used along with a corresponding drop in energy usage.

It is still another object of the present invention to provide a variable volume control assembly with a very low pressure drop across the assembly.

It is a further object of the present invention to provide a variable volume control assembly that operates over a wide range of flow velocities without generating appreciable noise.

The variable volume control assembly of the present invention has particular usefulness in air distribution systems where air, conditioned at a central source, is delivered at a somewhat constant temperature in varying amounts to a plurality of rooms or zones. The desired temperature in any one zone is adjusted by varying the volume of conditioned air delivered to that zone. In the prior art assemblies, the volume of air delivered was usually regulated by a thermostat located strategically within the zone. The volume of conditioned air delivered into the zone is controlled by a throttling device located in the variable volume control box for that zone. When the thermostat calls for additional conditioned air, the throttling device, usually a damper means, is driven to a further open position thus delivering additional quantities of conditioned air. When the desired temperature is reached, the thermostatic control drives the damper means to the closed position thus reducing or stopping the flow of conditioned air. Unless a limit means is placed on the opening of the damper, the damper will continue to open until it is in its maximum open position. When the damper is open to this extent, the flow of air exceeds the optimum level creating undesirable noise, drafty conditions within the zone, and over-conditioning of the zone with a resultant waste of energy. Accordingly, it is desirable to have a high limit means to control the opening of the damper. Similarly, unless a limit means is placed on the closing of the damper, the flow of conditioned air may be below the desired minimum or even stopped completely. Accordingly, it is desirable to have a low limit means.

In the assembly of the present invention, it is desirable to have a high limit and a low limit, although the low limit is optional. The high limit and low limit means for limiting the opening and closing of the damper is controlled by an air flow amplifying sensing means that acts upon the sensed differential between the total pressure and static pressure in the variable volume control assembly. In the desired operation, if the pressure differential caused by the flow of conditioned air through the control assembly exceeds the upper control limit, the thermostatic control is overriden and the damper is driven towards the closed position. When the damper has been closed sufficiently to bring the flow rate (and resulting pressure differential) to acceptable levels, the velocity-pressure sensitive limiting means is taken out of the control circuit and the flow of conditioned air is controlled by the thermostatic control. In the preferred operation, the variable volume control assembly also has a minimum pressure differential to make sure that the volume of air to the zone is not reduced below a certain minimum level thus stopping necessary air circulation.

As mentioned above, one of the main drawbacks of the prior art variable volume control assemblies is the air flow sensing means. The sensitivity of the prior art assemblies is not as sensitive as desired. Accordingly, larger quantities of air than are actually needed are delivered to the various zones. When the thermostatic control calls for additional conditioned air, more than the necessary amount will be delivered because of the inability to precisely limit the maximum flow. The result is a zone that is temporarily overheated or overcooled. This over-conditioning is inefficient from an energy use standpoint. Moreover, even when the thermostatic control is not demanding additional conditioned air, too much conditioned air may be delivered. Because of the inability to control the flow at low rates, more air than is really needed to maintain the zone at the desired temperature is constantly being delivered. This is a very inefficient and costly use of conditioned air and energy.

It is an important object of the present invention to provide a variable volume control assembly that is more sensitive to the air flow and pressure variations than the prior art assemblies. The present invention has an air flow sensing means that amplifies the difference between the total pressure and the static pressure. By amplifying the difference between the static pressure and the total pressure, the improved sensing means gives much better control over the volume of conditioned air delivered to any particular zone along with concomitant energy savings.

It is also an object of this invention to provide a new way of obtaining controlled air flow conditioning with an air flow measuring assembly without the need for 2–3 diameters of straight duct ahead of the variable volume control assembly as is necessary with existing equipment. A flow collector-straightener or scrim is placed in the inlet to reduce turbulent air flow and gather and collect air flow of a rather constant magnitude regardless of inlet duct configuration. This enables the air flow sensing device to more accurately measure the flow conditions. This scrim is an improvement over the prior art assemblies.

The variable volume control assembly of the present invention also has a lower pressure loss than the prior art assemblies. The lower pressure loss results in a lower pressure differential and is, to a large extent, the result of the ratio of the cross-sectional area of the inlet plenum to the cross-sectional area of the expansion box of the control assembly. By controlling the ratios of these cross-sectional areas, the pressure loss across the assembly can be kept to a minimum thus saving on the amount of energy necessary to deliver any given flow of conditioned air to a zone.

In addition, the variable volume control assembly of the present invention generates less noise than the prior art units. The assembly has a vortex filter that breaks up larger turbulences and increases their frequency. Higher frequencies can be absorbed more easily with simple sound traps and insulation thus causing an improved and lower sound discharge. The filter is strategically located in the outlet of the control assembly to break up the turbulence caused by the conditioned air passing through the assembly in addition to any incoming turbulence that still remains.

Embodiments of the control assembly of the present invention and its method of operation will be described in more detail hereinafter, particularly with reference to the attached drawings.

Figure 1:
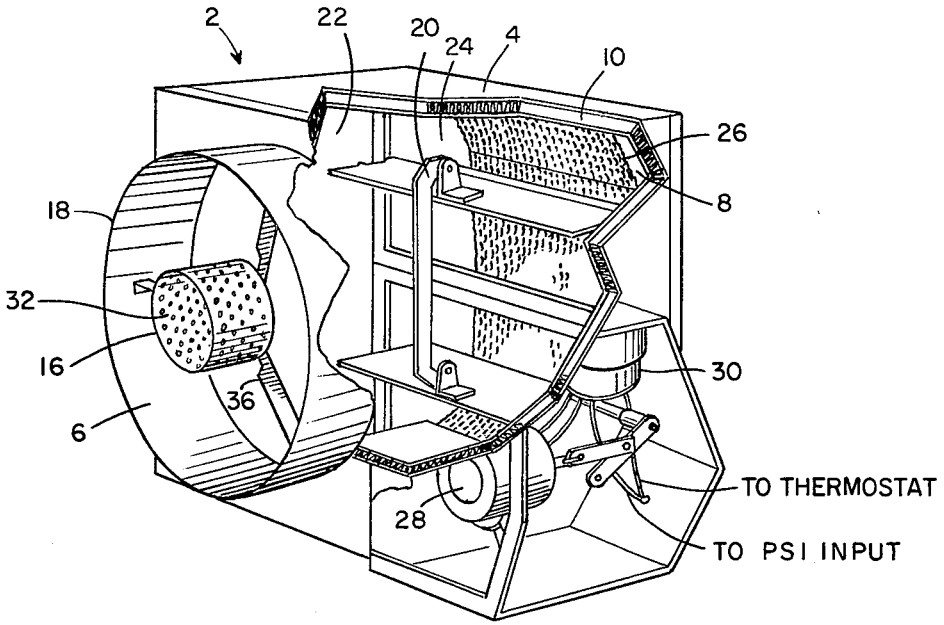
FIG. 1 is a perspective view of a variable volume control assembly of the present invention.
Figure 2:
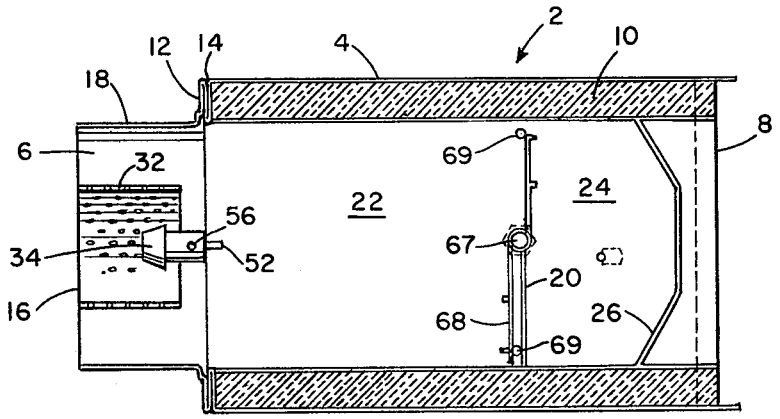
FIG. 2 is a cross-sectional side view of a variable volume control assembly of the present invention.
Figure 3:
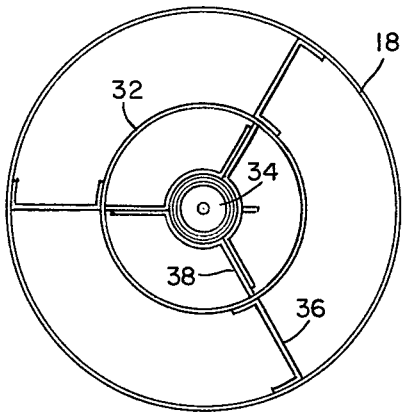
FIG. 3 is an end view into an air flow sampling and sensing assembly of the present invention.
Figure 4:
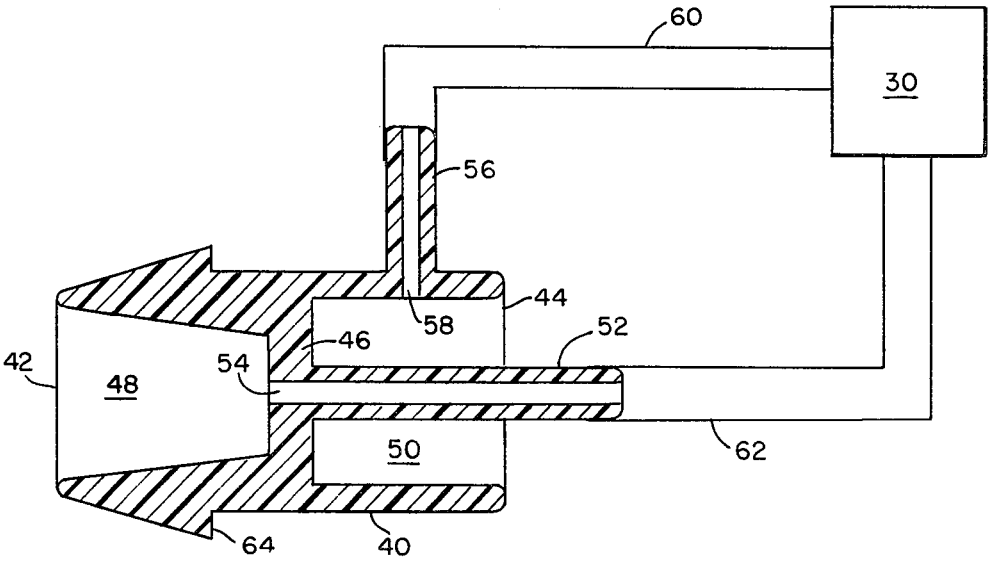
FIG. 4 is a schematic side view of the air flow sensing apparatus of the variable volume control assembly.

With respect to FIGS. 1, 2 and 3, the variable volume control assembly 2 comprises a generally rectangular-shaped box 4 having an inlet end or an upstream end 6 thereof and an outlet 8 in the opposite or downstream end thereof. The box is made of sheet metal or other suitable material and is generally lined with insulation material 10. The inlet is generally comprised of a circular plenum collar 18 that is attached by suitable fastening means 12 including gaskets 14 to the inlet in the end of the box. Located centrally within and affixed to the inlet plenum is the air flow sampling and sensing assembly 16. Located near the center of the box is a throttling device 20 for controlling the flow of air through the box. In FIG. 1, the throttling device is a damper means having two blades, while the throttling device in FIG. 2 is a damper means having a single blade. The damper means 20 divides the box into an expansion chamber 22 and an outlet chamber 24. Located downstream of the damper means and generally in the outlet 8 is a vortex filter 26 for reducing turbulence caused by the damper assembly, the air flow sampling and sensing assembly, and any turbulence remaining in the incoming air. Located externally of the box is a motor means 28 for moving the dampers and a logic analyzer control means 30 for actuating the motor means.

As mentioned above, disposed centrally within the inlet plenum 18 is an air flow sampling and sensing assembly 16. The air flow sampling and sensing assembly is oriented for maximum effectiveness. The air flow sampling and sensing assembly is comprised of a flow collector-straightener 32 and an air flow amplifier sensor 34. The flow collector-straightener or scrim 32 is affixed to the inlet plenum 18 by web assembly 36. The air flow amplifier sensor 34 is affixed to the flow collector-straightener 32 by web assembly 38. As is realized, web assemblies 36 and 38 can be combined into one assembly. Alternatively, the scrim 32 and air flow amplifier sensor 34 may be held in position by numerous other well-known methods.

The flow collector-straightener 32 is preferably disposed centrally within the inlet plenum 18 and the air flow amplifier sensor 34 is disposed centrally within the flow collector-straightener 32. The collector-straightener makes sure that a representative sample of incoming air is sampled by the air flow amplifier sensor. The collector-straightener is preferably a perforated tubular member in which about 50 percent of the surface area is free area. The flow collector-straightener may also comprise a solid tubular member; however, a solid may cause a pressure loss across the variable volume control assembly. Accordingly, it is preferred that the flow collector-straightener be made from perforated material. The free space of the perforated material may comprise as much as 70 percent of the surface area. If the free space comprises substantially more than about 70 percent of the area, the collector-straightener will not insure representative sampling, particularly when the duct coming from the air source is attached to the inlet plenum at a 90° angle. Preferably the collector-straightener is made from perforated material having about 50 percent free area. Flow collector-straighteners having the above mentioned properties actually bite into the incoming air and provide good representative sampling to the air flow amplifier measurer means regardless of the duct inlet approach.

Alternatively, the flow collector-straightener may be in the shape of a truncated cone that is inwardly tapered in the direction of flow. The cone angle may vary from about 45° to 90° (where it is tubular). If the cone angle is substantially less than 45°, the flow collector-straightender would be more like a plate that obstructs the flow. This would cause an increased pressure loss across the assembly and would not provide representative samples when the inlet duct was at an angle. Accordingly, cone angles between 45° and 90° are preferred. The cone is preferably made of perforated material as described above for the tubular-shaped flow collector-straightener. Cone-shaped flow collector-straighteners having the above described properties are as effective as the tubular-shaped flow collector-straighteners. The tubular-shaped collector-straighteners are preferred because of their ease of construction and use. The flow collector-straightener is arranged facing upstream so that the tubular or larger connular opening is parallel to the inlet plenum opening and gas flow direction.

As mentioned above, a flow amplifier sensor is located in the center of the collector-straightener. The amplifier sensor is an important aspect of the present invention and is more sensitive than the flow measuring devices of the prior art. For achieving the increased sensitivity, the amplifier has a tube divided by a wall into an upstream chamber and a downstream chamber. The upstream chamber can have a constant orifice but preferably the walls are tapered to form a tapered chamber section. A total pressure sensing probe is located in the center of the tube and has its opening in the upstream chamber of the tube. The total pressure sensing probe has its opening parallel to the flow of gas and facing upstream. The opening of the total pressure sensing probe is preferably in the wall dividing the tube into the upstream and downstream chambers. A static pressure sensing probe is located in the walls of the tube in the downstream chamber and has its opening perpendicular to the flow of gas. The static pressure sensing probe may also have its opening in the wall dividing the tube into the upstream and downstream chambers, in which case, the opening is parallel to the flow of gas and facing downstream. The flow pressure or velocity pressure of the flowing gas is sensed by comparing the sensed total pressure and the sensed static pressure; the total pressure being equal to the sum of the static pressure and the velocity pressure.

The location of the static pressure sensing probe in the downstream chamber of the tube is believed to amplify the sensed pressure differential by reducing the sensed static pressure. The flow of air through the plenum and around the tube causes a false static pressure reading in the downstream chamber that is lower than the true static pressure of the system. The area in the downstream chamber has an artificially reduced static pressure. By locating the static pressure probe in the downstream chamber where the sensed static pressure is artificially depressed, a large pressure differential between total pressure and static pressure is obtained. This amplification of the pressure differential and hence velocity pressure also occurs at even low flow velocities, thus providing a more sensitive measuring apparatus. As can be realized, the amount of depression of the static pressure is related to factors such as the size of the downstream chamber and the location of the static sensing probe within this chamber. The static pressure probe should not be located too near either end of the downstream chamber.

The total pressure sensing probe is located in the center of the tube in the upstream chamber section and is parallel to the flow of gas with its opening facing upstream. By locating the opening of the total sensing probe near the center of the tube in the upstream chamber a more representative reading of total pressure is obtained. The tube, especially when tapered, acts as a flow collector and straightener, thereby providing a more representative reading of total pressure. The total sensing probe may be located anywhere in the upstream chamber section. Care should be taken in not locating the total pressure probe too near the upstream opening of the tube or else the advantages of the tube acting as a flow collector-straightener will not be realized. As mentioned above, the orifice in the upstream chamber of the tube may be constant or tapered. It is preferred that it be tapered. It is also preferred that the opening of the total pressure sensing probe be in the center of the wall dividing the tube into an upstream chamber and downstream chamber.

The amplifier sensor 34 is better described with respect in FIGS. 2–6 in which a tube 40 is provided through which a portion of the air flowing in inlet plenum 18 must pass. The tube has an upstream end 42 and a downstream end 44 with the opening of the tube parallel to the direction of flow. A wall 46 divides the tube into an upstream chamber 48 and a downstream chamber 50. The orifice in the upstream chamber is preferably tapered inwardly so chamber 48 is a tapered chamber section. A total pressure sensing probe or tap 52 is positioned in the center of the tube and has its inlet opening 54 parallel to the flow of gas and facing upstream. The inlet opening is preferably located in the center of wall 46.

Wall 46 divides the tube into tapered upstream chamber 48 and downstream chamber 50. The orifice of downstream chamber 50 is preferably larger than the orifice at the tapered end of upstream chamber 48. The orifice of downstream chamber 50 is preferably constant across the remainder of the tube although it may be tapered inwardly or outwardly. A static pressure sensing probe or tap 56 is located in the walls of the tube in the downstream chamber. The inlet opening 58 of the static pressure probe is perpendicular to the flow of gas. Sensing probes 52 and 56 are connected by tubes 60 and 62, respectively, to control logic means 30. Control means 30 is responsive to the pressure differential sensed by probes 52 and 56 and is used to operate motor means 28 to open or close throttling means 30. It should be noted that some control means may require that air be bled into the sensor through static probe 56. The amplifier sensor apparatus of the present invention is operable under these conditions.

Figure 5:
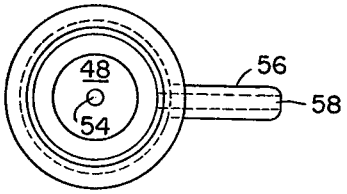
FIG. 5 is an end view of an air flow sensing apparatus as in FIG. 4.
Figure 6:
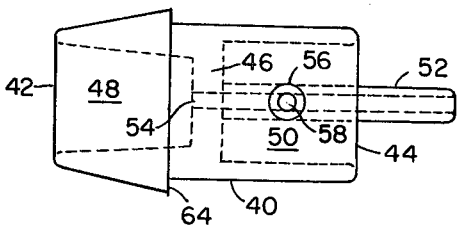
FIG. 6 is a side view of an air flow sensing apparatus as in FIG. 4.

With respect to FIGS. 5 and 6, the preferred amplifier sensor of the present invention described above is further illustrated in more detail. Tube 40 has an upstream end 42 and a downstream end 44. Wall 46 divides the tube into upstream chamber 48 and downstream chamber 50. The orifice in the upstream chamber is tapered inward and the orifice in the downstream chamber is constant. A total sensing probe 52 having an opening 54 parallel to the flow of gas and facing upstream is located in the center of the tube with the opening being in wall 46. A static pressure probe 56 is provided with its opening 58 located in the walls of the downstream chamber. The opening of the static pressure probe is perpendicular to the flow of gas and is located in the walls of the downstream chamber. Tube 40 also has a nipple 64 which is optional and which may be useful for holding the air flow amplifier measurer 34 in collector-straightener 32.

Figure 7:
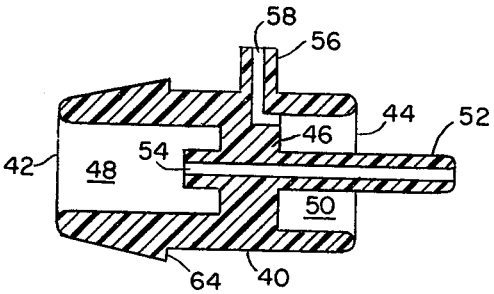
FIG. 7 is a schematic side view of an alternate air flow sensing apparatus.

With respect to FIG. 7, there is shown an alternate embodiment of the present invention. Tube 40 has an upstream end 42 and a downstream end 44. Wall 46 divides the tube into upstream chamber 48 and downstream chamber 50. The orifice in the upstream end is constant. A total pressure sensing probe 52 is located in the center of the upstream chamber and has its opening 54 parallel to the flow of gas and facing upstream. A static pressure sensing probe 56 is located in the downstream chamber. The opening 58 of static pressure probe is located in wall 46 that divides the tube into chambers and is parallel to the flow of gas and facing downstream.

As would be realized, there are other embodiments of the amplifier sensor. The important feature of all the embodiments being the static pressure probe being located in the area of artificially reduced static pressure that is in the downstream chamber. It is believed that the static pressure in the plenum or other passage is different from the static pressure in the downstream chamber of the sensing tube with the static pressure in the probe being lower. By locating the static pressure probe in the location where the static pressure is at its lowest, the sensed pressure differential is maximized.

The variable volume box 4 is divided into two chambers, an expansion chamber 22 and an outlet chamber 24, by the damper means 20. An important feature of the present invention is the ratio of the cross-sectional area of the inlet plenum to the cross-sectional area of the expansion box. It has been found that when the ratio of the cross-sectional area of the inlet box to the cross-sectional area of the expansion box is between about 1:1.25 to about 1:2, preferably between 1:1.4 to 1:1.6, the pressure loss across the unit is minimized. When the ratio of the cross-sectional area of the inlet plenum to the cross-sectional area of expansion chamber is around 1:1, there is a high pressure loss across the assembly and more energy is required to get the necessary flow of air through the assembly. Similarly, if the ratio is around 1:2, too much expansion will occur in the expansion chamber thus increasing the amount of energy used.

The variable volume control assembly of the present invention is quieter than the prior art assemblies. The reduced noise level is a result of the strategic location of the vortex filter 26. The vortex filter is a piece of perforated material and may be V-shaped, as illustrated in FIG. 1, or truncated V-shaped, as illustrated in FIG. 2. The vortex filter is located in the box 4 downstream of the damper means 20 with the point of the V pointing downstream. The point of the V or the truncated flat surface is preferably in the vertical plane of the outlet although it may be moved slightly downstream or upstream without substantially affecting its operation. It is important that the filter be located downstream of the damper means. By being downstream of the damper means, the vortex filter filters vortices that are created by the damper means and any vortices that are created by the air flow sampling and measuring assembly. It also filters any reamining large vortices that were in the incoming air stream. By breaking up the large turbulence of the vortices, the vortex filter aids in the reduction of the noise level. It breaks up the vortices and thus increases their vibration frequency thus making their attentuation by sound traps and insulation material more easily attainable.

As mentioned above, the vortex filter is V-shaped or truncated V-shaped with the point of the V or the flat truncated surface pointing downstream. The V-shaped filter is preferred when the damper means has only one blade. The truncated V-shaped filter is preferred when the damper means has more than one blade.

The V-shaped or truncated V-shaped filter is generally attached to the top of the box and the bottom of the box. The filter extends substantially over the width of the box. While the filter may extend from one side of the box to the other, it is preferred that the width of the filter be about 70 percent of the length of the damper. It has been found that this allows a lower pressure loss across the box.

The vortex filter is made out of perforated material. The free space of the perforated material may vary from about 25 percent to about 70 percent, preferably the free space will be about 50 percent of the surface area of the filter. If more than 70 percent free space is used, the filter will not be as effective in reducing turbulence and resulting noise as desirable. Also, if less than 25 percent free space is used, the filter will not only fail to reduce the turbulence as desired, but will increase the pressure loss across the unit.

Mounted within box 4 to control the flow of conditioned air through the box is damper means 20. Damper means 20 may be comprised of a single damper, as illustrated in FIG. 2, or multiple dampers, as illustrated in FIG. 1. The single damper comprises a blade 68 which is adapted to rotate about rod 67 which passes between the side walls of box 4 and is journaled in bearings (not shown). The rotation of the damper is effected by motor means 28 in response to a signal from logic analyzer means 30. The damper means may be connected to the motor means by any of the well-known methods.

Preferably, damper stops or gaskets 69 may be provided along the top and bottom walls of the box to allow the damper to reach a securely closed position within the terminal box. A damper stop (not shown) may also be positioned within the center of the outlet chamber to limit the rotation of the damper to a fully open position.

The damper means may also comprise a plurality of blades and rods (see FIG. 1) that are mounted for individual rotation or that are mounted for rotation when one of the rods is rotated. A damper means having a plurality of blades is preferred for larger size assemblies.

A damper means having a single blade is preferred for smaller assemblies.

Located external of box 4 is motor means 28 and logic analyzer means 30. Motor means 28 and logic analyzer means 30 are preferably attached to the side of box 4 and covered by a protective shroud. Motor means 28 causes the damper means to open or close in response to a signal from logic analyzer 30. Logic analyzer means 30 is operably connected to the total pressure sensing probe and the static pressure sensing probe of the amplifier sensor by appropriate means such as tubing members 60 and 62. Logic analyzer 30 is also operably connected to a thermostatic control that is located at some appropriate point within the zone to be conditioned and to a source of power. The preferred source of power is a 20 psi main air source.

Logic analyzer 30 continually receives readings from the total pressure sensing probe, static pressure sensing probe and thermostatic control. Then, depending on the manner in which the logic analyzer has been preprogrammed, it sends a signal to motor means 28 to open or close the throttling means. Logic analyzer may have a high limit, low limit or a combination of high/ low. Logic analyzer may also require air to be bled into the air flow measuring means through the static pressure probe.

We claim:

1. An improved variable volume control assembly for controlling the flow of conditioned air into a zone of the type comprising:

a box having an inlet in one end for receiving conditioned air from a source of conditioned air and an outlet in the other end for delivering conditioned air to the zone;

an inlet plenum for connecting the box with ducting from the source;

damper means located within the box for controlling the flow of air through the box, the damper means dividing the box into an expansion chamber and an outlet chamber;

air flow sensing means for sensing the flow of air through the box;

motor means located externally of the box for controlling the opening and closing of the damper means;

control means located externally of the box and responsive to the temperature in the zone and the flow of conditioned air through the box for controlling the operation of the motor means;

wherein the improvement comprises the air flow sensing means comprising a tube having an upstream end and a downstream end, a wall dividing the tube into an upstream chamber and a downstream chamber, a total pressure sensing probe located in the tube and having its opening in the center of the wall dividing the tube into the upstream and downstream chambers and facing upstream, a static pressure sensing probe located in the walls of the downstream chamber of the tube and having its opening perpendicular to the flow of gas, means for connecting the total pressure probe and static pressure probe to the control means.

2. An improved variable volume control assembly as in claim 1 wherein the orifice of the upstream chamber of the air flow sensing means is tapered inward.

3. An improved variable volume control assembly for controlling the flow of conditioned air into a zone of the type comprising:

a box having an inlet in one end for receiving conditioned air from a source of conditioned air and an outlet in the other end for delivering conditioned air to the zone;

an inlet plenum for connecting the box with ducting from the source;

damper means located within the box for controlling the flow of air through the box, the damper means dividing the box into an expansion chamber and an outlet chamber;

air flow sensing means for sensing the flow of air through the box;

motor means located externally of the box for controlling the opening and closing of the damper means;

control means located externally of the box and responsive to the temperature in the zone and the flow of conditioned air through the box for controlling the operation of the motor means;

wherein the improvement comprises the air flow sensing means comprising a tube having an upstream end and a downstream end, a wall dividing the tube into an upstream chamber and a downstream chamber, a total pressure sensing probe located in the tube and having its opening in the center of the wall dividing the tube into the upstream and downstream chambers and facing upstream, a static pressure sensing probe located in the wall dividing the tube into the upstream and downstream chambers and having its opening parallel to the flow of gas and facing downstream, means for connecting the total pressure probe and static pressure probe to the control means.

4. An improved variable volume control assembly as in claim 3 wherein the orifice of the upstream chamber of the air flow sensing means is tapered inward.

* * * * *